US006971592B2

(12) United States Patent
Boecking

(10) Patent No.: US 6,971,592 B2
(45) Date of Patent: Dec. 6, 2005

(54) FUEL INJECTION DEVICE FOR AN INTERNAL COMBUSTION ENGINE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 193 days.

(21) Appl. No.: 10/686,591

(22) Filed: Oct. 17, 2003

(65) Prior Publication Data

US 2004/0129805 A1 Jul. 8, 2004

(30) Foreign Application Priority Data

Oct. 17, 2002 (DE) ..... 102 48 379

(51) Int. Cl.[7] ..... F02M 59/00; F02M 61/00; F02M 47/02; B05B 1/30

(52) U.S. Cl. ..... 239/533.2; 239/533.1; 239/533.12; 239/88; 239/585.1; 239/585.4; 239/585.5

(58) Field of Search ..... 239/533.2, 533.1, 239/533.3, 533.11, 533.12, 88–93, 585.1, 239/585.3, 585.4, 585.5; 251/129.15, 129.21, 251/127

(56) References Cited

U.S. PATENT DOCUMENTS

| | | | | |
|---|---|---|---|---|
| 4,167,168 | A * | 9/1979 | Yamamoto | 123/467 |
| 4,459,963 | A * | 7/1984 | Gross et al. | 123/506 |
| 4,549,515 | A * | 10/1985 | Maisch | 123/452 |
| 4,907,555 | A * | 3/1990 | Fuchs | 123/446 |
| 6,105,879 | A * | 8/2000 | Potz et al. | 239/88 |

FOREIGN PATENT DOCUMENTS

| | | |
|---|---|---|
| DE | 41 15 477 A1 | 11/1991 |
| EP | 0 967 383 A2 | 12/1999 |
| EP | 0 978 649 A2 | 2/2000 |
| EP | 1 063 415 A2 | 12/2000 |

* cited by examiner

*Primary Examiner*—Davis Hwu
(74) *Attorney, Agent, or Firm*—Ronald E. Greigg

(57) ABSTRACT

A fuel injection device of an internal combustion engine includes a housing with an injection region. The housing contains a recess in which two valve elements are disposed. The inner valve element is shorter than the outer valve element. A loading device at least sometimes acts on the inner valve element in the opening direction. A control piston cooperates with the inner valve element. It has a pressure surface, which delimits a control chamber and whose force resultant points in the closing direction. The loading device exerts an approximately constant opening force on the inner valve element. The fluid pressure in the control chamber can be temporarily reduced.

20 Claims, 2 Drawing Sheets

FUEL INJECTION DEVICE FOR AN INTERNAL COMBUSTION ENGINE

BACKGROUND OF THE INVENTION

1. Field of the Invention

The invention relates to a fuel injection device for an internal combustion engine having a housing with an injection region, having a recess provided in the housing, and having at least two valve elements disposed coaxial to each other in the recess that respectively cooperate with a valve seat in the injection region, wherein the inner valve element is shorter than the outer valve element, wherein a loading device is provided, which at least sometimes acts on the inner valve element in the opening direction, wherein a control piston is provided, which cooperates with the inner valve element, and wherein the control piston has a pressure surface whose force resultant points in the closing direction and delimits a control chamber.

2. Description of the Prior Art

A fuel injection device of the type with which this invention is concerned is known from DE 41 15 477 A1 which discloses an injection nozzle with two valve needles that are disposed coaxial to each other and are "pressure-controlled". This means that the needles are loaded against the valve seat with a constant force by a helical compression spring. In the vicinity of the injection end, each of the valve needles has a respective pressure surface, which is acted on by the injection pressure and whose force resultant points in the opening direction. By increasing the injection pressure, the valve needles can be lifted away from the corresponding valve seats, counter to the force of the compression springs.

In the device disclosed in DE 41 15 477 A1, the inner valve needle is connected to a control piston, which in turn has a pressure surface that acts in the closing direction. If a high fluid pressure prevails in the pressure chamber delimited by the pressure surface, then a corresponding force acts in the closing direction, which prevents the inner valve needle from being able to lift away from the valve seat.

During operation of the fuel injection device mentioned at the beginning, however, optimal emissions and fuel consumption values are not achieved in some operating states of the engine.

OBJECT AND SUMMARY OF THE INVENTION

The object of the invention, therefore, is to improve a fuel injection device of the type mentioned at the beginning so that it achieves better fuel consumption and emissions values and is at the same time compact in design.

This object is attained with a fuel injection device in which the loading device exerts an approximately constant opening force on the inner valve element and in that a fluid pressure prevails in the control chamber, which can be temporarily reduced.

In the fuel injection device according to the invention, the inner valve element functions in a "stroke-controlled" manner. This means that the fuel pressure prevailing in the injection region can have the optimal value for each respective injection, without unduly influencing the opening behavior of the inner valve element. The inner valve element opens only when the fluid pressure in the control chamber is temporarily reduced. With a fuel injection device of this kind, a pressure curve is achieved during the injection of the fuel that permits the achievement of better emissions and lower fuel consumption of the engine in many practical applications. The short design of the valve elements lends the overall device a very compact construction.

In a first modification, the invention proposes that the inner valve element have a circumferential shoulder, which supports a first prestressing device that acts in the closing direction. A shoulder of this kind can be easily produced by machine on the valve element and even during the starting phase of the engine, when high fuel pressure has not yet built up in the control chamber, a prestressing device of this kind acting in the closing direction assures that the inner valve element rests against its valve seat and that no fuel is inadvertently delivered by the fuel injection device. Therefore this modification improves the operational reliability in an inexpensive manner.

In a modification of this embodiment, the invention proposes that the first prestressing device be supported on a sealing sleeve, which encompasses a sealing edge that a second prestressing device loads toward the outer valve element. In this modification, the first and second prestressing devices are thus connected in series. The corresponding fuel injection device is therefore comparatively narrow.

Another advantageous embodiment of the fuel injection device according to the invention is comprised in that the inner valve element is guided in the outer valve element in a fluid-tight manner and that between the control piston and the outer valve element, at least in some regions, an annular chamber is provided, which is connected to a low-pressure connection. Since the inner valve element is relatively short, the fluid-tight guide section must also extend over only a relatively short span. Fuel possibly passing through the guide section can travel to the low-pressure connection and can be drained from there as leakage fluid. The performance of the fuel injection device according to the invention is thus assured even with a short sealing span.

The invention also proposes that the control piston have a control section, on which the pressure surface is provided, and a transmitting section, which is disposed between the valve element and the control section and constitutes a separate part from the control section. This facilitates the manufacture of the individual parts so that as a whole, the fuel injection device according to the invention is inexpensive to produce. Furthermore, it is possible to select materials that are optimal for the respective function of the individual sections, for example a material can be selected for the control section, which in cooperation with the housing of the fuel injection device produces a good sealing action.

It is particularly preferable if the contact surface of the control section with the transmitting section is spherically curved and the corresponding contact surface on the transmitting section is embodied in a fashion complementary to this. This makes it very easy to compensate for centering errors that can occur due to manufacturing tolerances. On the one hand, this reduces the manufacturing costs of the fuel injection device according to the invention and on the other hand, permits the valve elements to move in a very favorable, easy fashion. The same is also true for the modification in which the contact surface of the valve element with the control piston is spherically curved and the corresponding contact surface on the control piston is embodied in a fashion complementary to this.

In a particularly advantageous modification, the invention proposes that the contact surfaces on the transmitting section in relation to the control section and the inner valve element each be part of a common spherical surface whose center point lies on the central axis of the transmitting section. This makes the transmitting section very easy to install and causes it to be centered automatically between the control section on the one hand and the inner valve element on the other.

BRIEF DESCRIPTION OF THE DRAWINGS

The invention will be better understood and further objects and advantages thereof will become more apparent from the ensuing detailed description of a preferred embodiment taken in conjunction with the drawings, in which.

DESCRIPTION OF THE PREFERRED EMBODIMENT

Figure 1:
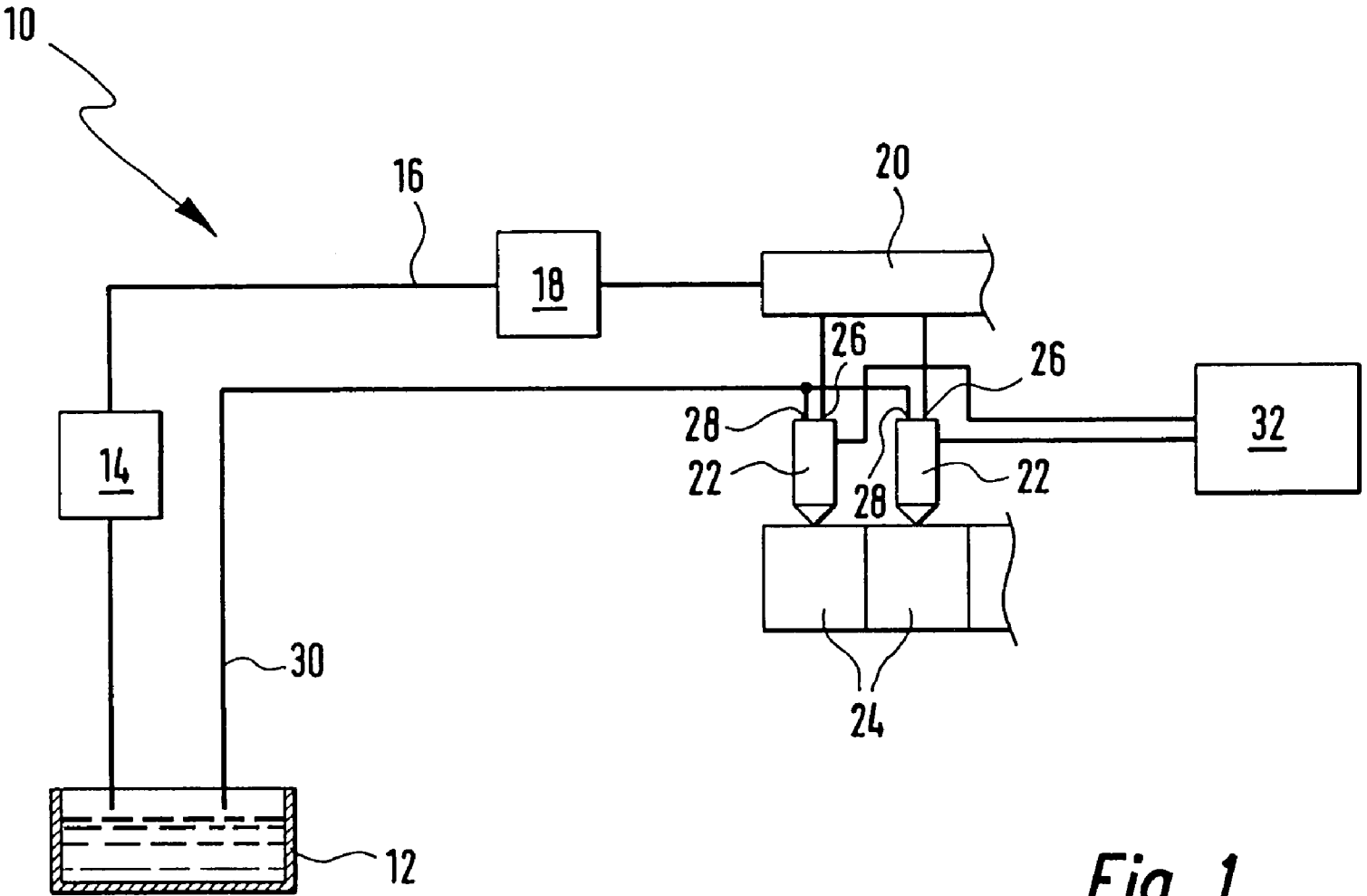
FIG. 1 shows a schematic depiction of an internal combustion engine with a number of fuel injection devices.

In FIG. 1, a fuel system of an internal combustion engine, labeled as a whole with the reference numeral 10, includes a fuel tank 12 from which an electric fuel pump 14 delivers fuel into a low-pressure fuel line 16.

This low-pressure fuel line 16 leads to a high-pressure fuel pump 18. A camshaft of the engine, not shown in the drawing, drives a high-pressure fuel pump 18 which delivers the fuel into a fuel accumulation line 20 ("rail"). This rail is connected to a number of fuel injection devices 22, which will be referred to below for the sake of simplicity as "injectors". Each of the injectors 22 injects the fuel directly into a respective combustion chamber 24 associated with it.

The injectors 22 are connected to the fuel accumulation line 20 by means of high-pressure connections 26. The injectors 22 are each connected to a return line 30 via a respective low-pressure connection 28. A control and regulating unit 32 controls and/or regulates the operation of the internal combustion engine, the fuel system 10, and in particular the injectors 22.

It is readily apparent that the above-described fuel system 10 belongs to an internal combustion engine with direct fuel injection. It can be used for both gasoline engines and diesel engines.

Figure 2:
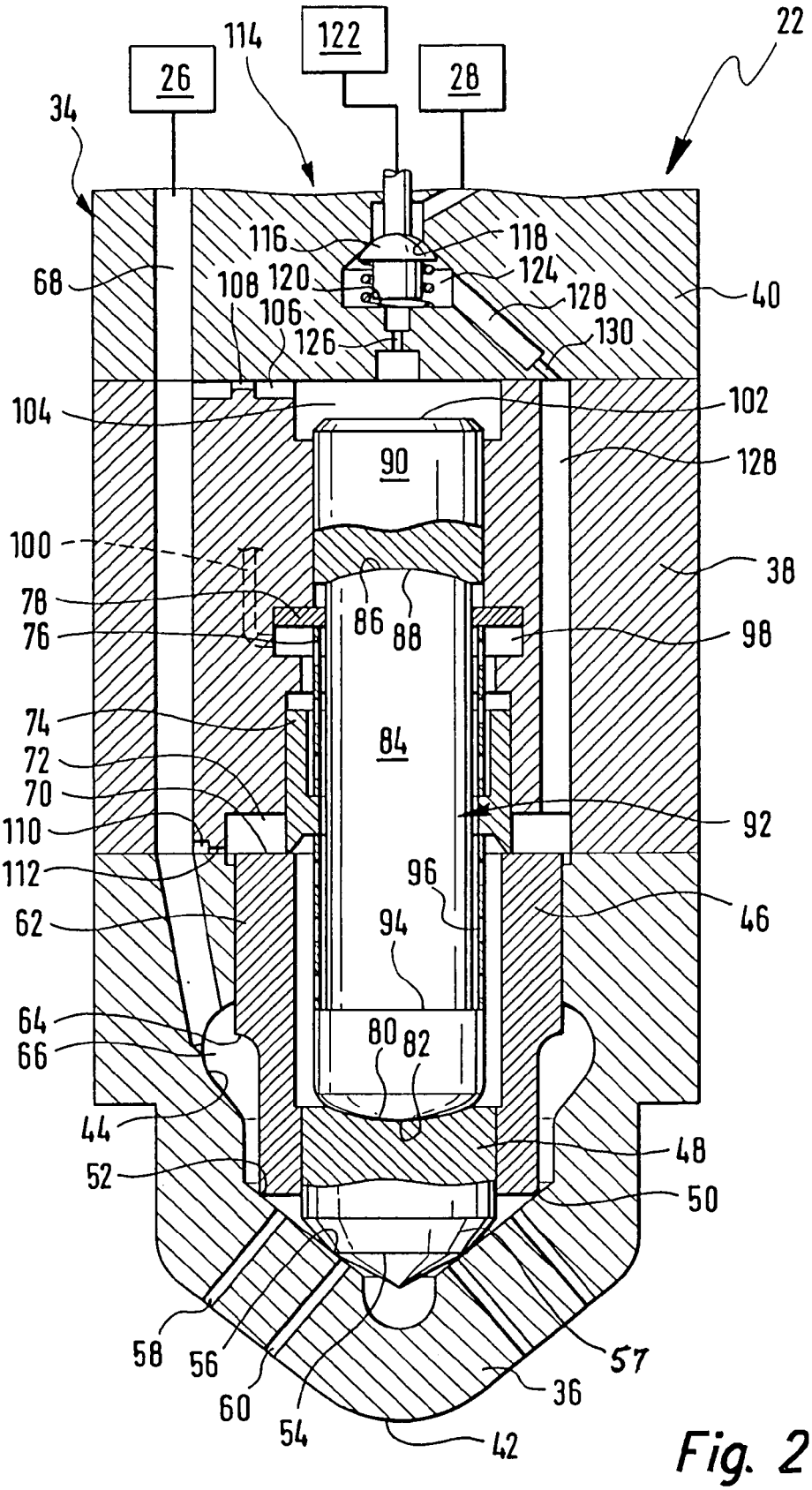
FIG. 2 shows a partial section through one of the fuel injection devices from FIG. 1.

The injector 22 shown in FIG. 2 includes a housing 34 with a nozzle body 36, a middle part 38, and an upper part 40 (here and in the text that follows, the directions "up" and "down" will refer to the depiction in FIG. 2; but the injector can in principle be installed in any position in space). At its end, the nozzle body 36 has an injection region 42, which is oriented toward the combustion chamber 24 when in the installed position.

The housing 34 has a recess 44 that contains two valve elements 46 and 48 that are disposed coaxially to each other. The outer valve element is tubular and at its lower end, has a sealing edge 50, which cooperates with a valve seat 52 at the lower end of the recess 44. The inner valve element 48 is guided in the outer valve element 46 in a fluid-tight manner. Its longitudinal span corresponds approximately to its diameter. The lower end of the inner valve element 48 tapers conically to a point. There are two regions, each with a different conicity, between which a sealing edge 54 is formed, which in turn cooperates with a valve seat 56 in the lower region of the recess 44. The conical region at the lower end of the inner valve element 48, which lies radially outside the sealing edge 54, constitutes a pressure surface 57 whose force resultant points in the opening direction of the inner valve element 48.

Radially inward from the valve seat 52, a number of fuel outlet conduits 58 are distributed over the circumference of the nozzle body 36. Further inward in the radial direction, radially inside the valve seat 56, there is another row of fuel outlet conduits 60 distributed over the circumference of the nozzle body 36. A guide section 62 guides the outer valve element 46 in a fluid-tight manner in the recess 44 in the nozzle body 36. Underneath the guide section 62, the outer valve element 46 has a slightly smaller diameter. The circumferential step resulting from this forms a pressure surface 64, whose force resultant points in the opening direction of the outer valve element 46. Extending approximately from the pressure surface 64 to the lower end of the outer valve element 46, an annular chamber that constitutes a pressure chamber 66 is provided between the outer valve element 46 and the wall of the recess 44. This pressure chamber 66 is connected to the high-pressure connection 26 via a high-pressure conduit 68.

The outer valve element 46 extends in the longitudinal direction to approximately the upper edge of the nozzle body 36. Its annular upper end wall constitutes a control surface 70, which delimits an annular control chamber 72. Toward the inside, radially, the control chamber 72 is delimited by a sealing sleeve 74, which rests with a relatively sharp sealing edge (no reference numeral) against the control surface 70 of the outer valve element 46. A tubular spring 76 loads the sealing sleeve 74 against the control surface 70. At the other end, the tubular spring 76 is supported against a support ring 78, which rests against a shoulder (no reference numeral) of the recess 44. As a result, on the one hand, the tubular spring 76 pushes the sealing sleeve 74 with the sealing edge against the control surface 70 and on the other hand, it presses the sealing edge 50 of the outer valve element 46 against the valve seat 52.

As is readily apparent from FIG. 2, the inner valve element 48 is considerably shorter than the outer valve element 46. Its upper boundary surface 80 is provided with a concave spherical curvature. A complementary contact surface 82 of the transmitting rod 84 rests flush against it. This transmitting section extends beyond the nozzle body 36 into the middle part 38 of the housing 34. An upper end surface 86 of the transmitting rod 84 is provided with a convex spherical curvature and a complementary contact surface 88 of a cylindrical control part 90 rests flush against it. This cylindrical control part is in turn guided in a fluid-tight, sliding fashion in the recess 44 in the middle part 38 of the housing 34. The lower contact surface 82 and the upper contact surface 86 of the transmitting rod 84 are disposed on a common spherical surface whose center point lies on the center axis of the transmitting rod 84. If so desired, a particularly low-friction layer can be provided between contact surfaces that touch one another.

The transmitting rod 84 and the control part 90 together constitute a control piston 92. In the region of its lower end, the transmitting rod 84 has a circumferential shoulder 94 that supports a tubular spring 96. The other end of the tubular spring 96 is supported against an inward-pointing annular rib (no reference numeral) of the sealing sleeve 74. This causes the transmitting rod 84 and consequently also the inner valve element 48 with the sealing edge 54 to be pressed against the valve seat 56. The diameter of the transmitting rod 84, however, is smaller than the inner diameter of the outer valve element 46. The same is also true for the relationship between the diameter of the transmitting rod 84 and the inner diameter of the sealing sleeve 74. The annular chamber 98 thus produced is connected to the low-pressure connection 28 of the injector 22 via a leakage line 100, which is only shown with dashed lines.

The upper end surface of the control part 90 constitutes a pressure surface 102, which delimits a control chamber 104. A fluid conduit 106, which is milled into the upper end surface of the middle part 38 and contains an inlet throttle 108, connects the control chamber 104 to the high-pressure conduit 68. Likewise, a fluid conduit 110, which is milled into the lower end surface of the middle part 38 and contains a flow throttle 112, connects the control chamber 72 to the high-pressure conduit 68.

A 3/3-port directional-control valve 114 is provided in the upper part 40. Its valve element 116 cooperates with an upper valve seat 118 and a lower valve seat 120. The control and regulating unit 32 triggers an actuator 122 that moves this valve element 116. The valve element 116 is contained in a switching chamber 124 and, in the region of the lower valve seat 120, a fluid conduit that contains an outlet throttle 126 connects this switching chamber 124 to the control chamber 104. In the region of the upper valve seat 118, the switching chamber 124 is connected to the low-pressure connection 28. A flow conduit 128 branches off from the side of the switching chamber and leads to the control chamber 72 via a throttle restriction 130.

The injector 22 functions as follows:

When no injection is to take place, the valve element 116 of the 3/3-port directional-control valve 114 rests against the upper valve seat 118. A compression spring (no reference numeral) pushes the valve element 116 into this switched position in which there is no fluid connection between the low-pressure connection 28 and the two control chambers 72 and 104. On the other hand, the control chambers 72 and 104 continue to be connected to the high-pressure connection 26 via the high-pressure conduit 68 and the fluid conduits 106 and 110.

Consequently, approximately the same pressure as the high fluid pressure prevailing at the high-pressure connection 26 prevails in the control chambers 72 and 104, which generates a corresponding hydraulic force on the control surfaces 70 and 102 acting in the closing direction of the valve elements 46 and 48. This hydraulic force acting in the closing direction is greater than the hydraulic force acting in the opening direction on the pressure surface 64 of the outer valve element 46. Consequently, the sealing edge 50 of the outer valve element 46 is pressed against the valve seat 52. Fuel cannot emerge from the fuel outlet conduits 58. Furthermore, only a slight amount of pressure acts on the pressure surface 57 so that the transmitting rod 84 and the control part 90 are also able to keep the sealing edge 54 of the inner valve element 48 pressed against the valve seat 56.

When the valve element 116 of the 3/3-port directional-control valve 114 rests against the lower valve seat 120, the control chamber 104 continues to be disconnected from the low-pressure connection 28; there is however, a fluid connection from the low-pressure connection 28 to the annular control chamber 72 via the switching chamber 124 and a flow conduit 128. This decreases the pressure in the control chamber 72 and causes a consequent drop in the corresponding hydraulic force acting on the control surface 70 of the outer valve element 46. Due to the hydraulic force acting on the pressure surface 44, the sealing edge 50 of the outer valve element 46 moves away from the valve seat 52. Fuel can therefore emerge from the fuel outlet conduits 58. Since at the same time, a high fluid pressure continues to prevail in the control chamber 104, however, the hydraulic force acting on the pressure surface 57 is not sufficient to also move the inner valve element 48.

If the intent is to also permit fuel to emerge from the fuel outlet conduits 60, then the valve element 116 of the 3/3-port directional-control valve 114 is brought into a middle switched position. In this position, both of the control chambers 72 and 104 are connected to the low-pressure connection 28. Consequently, the hydraulic force acting on the control surface 102 of the control part 90 decreases so that the hydraulic force acting on the pressure surface 57 can lift the sealing edge 54 of the inner valve element 48 away from the valve seat 56, as a result of which the flow path is opened from the high-pressure connection 26 to the fuel outlet conduits 60.

The foregoing relates to a preferred exemplary embodiment of the invention, it being understood that other variants and embodiments thereof are possible within the spirit and scope of the invention, the latter being defined by the appended claims.

I claim:

1. In a fuel injection device (22) for an internal combustion engine, the injection device (22) having a housing (34) with an injection region (42), having a recess (44) provided in the housing (34), and having at least two valve elements (46, 48), which are disposed coaxial to each other in the recess (44) and each cooperate with a respective valve seat (52, 56) in the injection region (42), wherein the inner valve element (48) is shorter than the outer valve element (46), wherein a loading device (57) is provided, which at least sometimes acts on the inner valve element (48) in the opening direction, wherein a control piston (92) is provided, which cooperates with the inner valve element (48), and wherein the control piston (92) has a pressure surface (102), which delimits a control chamber (104) and whose force resultant points in the closing direction, the improvement wherein the loading device (57) exerts an approximately constant opening force on the inner valve element (48), and wherein a fluid pressure prevails in the control chamber (104), which can be temporarily reduced.

2. The fuel injection device (22) according to claim 1, wherein the control piston (92) comprises a circumferential shoulder (94), and a first prestressing device (96) supported by the circumferential shoulder (94) and acting in the closing direction.

3. The fuel injection device (22) according to claim 2, further comprising a sealing sleeve (74), which includes a sealing edge that a second prestressing device (76) loads against the outer valve element (46), the first prestressing device (96) being supported on the sealing sleeve (74).

4. The fuel injection device (22) according to claim 3, wherein the inner valve element (48) is guided in a fluid-tight manner in the outer valve element (46), and wherein between the control piston (92) and the outer valve element (46), at least in some regions, an annular chamber (98) is connected to a low-pressure connection (28).

5. The fuel injection device (22) according to claim 3, wherein the control piston (92) comprises a control section (90), on which the pressure surface (102) is provided, and a transmitting section (84), which is disposed between the valve element (48) and the control section (90) and constitutes a separate part from the control section (90).

6. The fuel injection device (22) according to claim 5, wherein the contact surface (88) of the control section (90) with the transmitting section (84) is spherically curved and the corresponding contact surface (86) on the transmitting section (84) is complementarily curved.

7. The fuel injection device (22) according to claim 6, wherein the contact surface (80) of the inner valve element (48) with the control piston (92) is spherically curved and the corresponding contact surface (82) on the control piston (92) complementarily curved.

8. The fuel injection device (22) according to claim 2, wherein the inner valve element (48) is guided in a fluid-tight manner in the outer valve element (46), and wherein between the control piston (92) and the outer valve element (46), at least in some regions, an annular chamber (98) is connected to a low-pressure connection (28).

9. The fuel injection device (22) according to claim 2, wherein the control piston (92) comprises a control section (90), on which the pressure surface (102) is provided, and a transmitting section (84), which is disposed between the valve element (48) and the control section (90) and constitutes a separate part from the control section (90).

10. The fuel injection device (22) according to claim 9, wherein the contact surface (88) of the control section (90) with the transmitting section (84) is spherically curved and the corresponding contact surface (86) on the transmitting section (84) is complementarily curved.

11. The fuel injection device (22) according to claim 10, wherein the contact surface (80) of the inner valve element (48) with the control piston (92) is spherically curved and the corresponding contact surface (82) on the control piston (92) complementarily curved.

12. The fuel injection device (22) according to claim 1, wherein the inner valve element (48) is guided in a fluid-tight manner in the outer valve element (46), and wherein between the control piston (92) and the outer valve element (46), at least in some regions, an annular chamber (98) is connected to a low-pressure connection (28).

13. The fuel injection device (22) according to claim 12, wherein the control piston (92) comprises a control section (90), on which the pressure surface (102) is provided, and a transmitting section (84), which is disposed between the valve element (48) and the control section (90) and constitutes a separate part from the control section (90).

14. The fuel injection device (22) according to claim 10, wherein the contact surface (88) of the control section (90) with the transmitting section (84) is spherically curved and the corresponding contact surface (86) on the transmitting section (84) complementarily curved.

15. The fuel injection device (22) according to claim 14, wherein the contact surface (80) of the inner valve element (48) with the control piston (92) is spherically curved and the corresponding contact surface (82) on the control piston (92) complementarily curved.

16. The fuel injection device (22) according to claim 1, wherein the control piston (92) comprises a control section (90), on which the pressure surface (102) is provided, and a transmitting section (84), which is disposed between the valve element (48) and the control section (90) and constitutes a separate part from the control section (90).

17. The fuel injection device (22) according to claim 16, wherein the contact surface (88) of the control section (90) with the transmitting section (84) is spherically curved and the corresponding contact surface (86) on the transmitting section (84) is complementarily curved.

18. The fuel injection device (22) according to claim 17, wherein the contact surface (80) of the inner valve element (48) with the control piston (92) is spherically curved and the corresponding contact surface (82) on the control piston (92) complementarily curved.

19. The fuel injection device (22) according to claim 17, wherein the contact surface (80) of the inner valve element (48) with the control piston (92) is spherically curved and the corresponding contact surface (82) on the control piston (92) complementarily curved, and wherein the contact surfaces (82, 86) on the transmitting section (84) in relation to the control section (90) and the inner valve element (48) are each part of a common spherical surface whose center point lies on the central axis of the transmitting section (84).

20. The fuel injection device (22) according to claim 1, wherein the contact surface (80) of the inner valve element (48) with the control piston (92) is spherically curved and the corresponding contact surface (82) on the control piston (92) complementarily curved.

* * * * *